United States Patent [19]

Williamson

[11] Patent Number: 4,628,721

[45] Date of Patent: Dec. 16, 1986

[54] METHOD OF ROLL FORMING CYLINDRICAL PIPE

[75] Inventor: Calvin C. Williamson, Napa, Calif.

[73] Assignee: Kaiser Steel Corporation, Fontana, Calif.

[21] Appl. No.: 753,327

[22] Filed: Jul. 9, 1985

Related U.S. Application Data

[62] Division of Ser. No. 610,707, May 16, 1984.

[51] Int. Cl.[4] ..... B21D 5/14

[52] U.S. Cl. ..... 72/370; 72/51; 72/133; 72/175

[58] Field of Search ..... 72/51, 52, 133, 169, 72/170, 171, 173, 174, 175, 368, 370, 389; 228/17, 17.5, 17.7, 150, 151

[56] References Cited

U.S. PATENT DOCUMENTS

| | | | |
|---|---|---|---|
| 2,197,906 | 4/1940 | Tucker | 72/175 |
| 2,587,975 | 3/1952 | Darner | 72/134 |
| 2,612,934 | 10/1952 | Duboscard | 72/174 |
| 2,742,078 | 4/1956 | Williams | 72/171 X |
| 2,882,767 | 4/1959 | Chatfield | 72/175 X |
| 3,103,965 | 9/1963 | Savory | 72/173 X |
| 3,738,149 | 6/1973 | Archer | 72/171 |
| 4,304,114 | 12/1981 | Wiig | 72/175 X |

*Primary Examiner*—E. Michael Combs

*Attorney, Agent, or Firm*—Burns, Doane, Swecker & Mathis

[57] ABSTRACT

The method and apparatus for rolling a section of metal plate into a cylindrical pipe section wherein leading and trailing edges of said plate section are pre-crimped to the final desired radius of said cylindrical pipe section, feeding the leading edge of said plate section into a forming mill that includes an overhead mandrel having a radius approximating said final desired radius of said pipe section, forcing said mandrel to deflect along the length thereof during the forming of said plate section between said mandrel and a pair of driven bending roll means whereby said mandrel and said bending roll means are maintained at the same curvature throughout the length thereof and said plate section is uniformly bent along the length thereof to said desired final radius.

3 Claims, 31 Drawing Figures

W
70
30
32
26
25
14
250
250'
252
254
256
258
260
260'
262
264
266
266'
268
270
270'
274
276
278
280
281
282
284
284'
286

METHOD OF ROLL FORMING CYLINDRICAL PIPE

This application is a division of application Ser. No. 610,707, filed May 16, 1984.

BACKGROUND OF THE INVENTION

This invention relates to an apparatus and method for forming pipe from steel plates and sheets, and more particularly relates to an efficient relatively low cost apparatus for forming long sections of large diameter steel pipe from relatively thick gauge steel plate.

The pyramid roll forming process is one of the earliest commercial methods for forming steel plates into large diameter pipes. The U-O process is a frequently used method for forming large diameter pipe. The pyramid method has serious limitations by way of size and product quality, and the U-O-E method, although excellent in many respects, has the disadvantage of high equipment cost.

In the pyramid method flat plate to be formed into a circular section is brought into position between the top and bottom rolls with one edge of the plate resting on the bottom roll further away from the center of the plate. The top roll is then moved downward by screws or the like which impart a downward force on the steel plate causing the plate to bend between the two bottom rolls. As the botom rolls are rotated, bending of the plate commences and continues from one edge of the plate to the other as the plate is wrapped around the top roll and is formed into a circular shape.

Since bending of the plate occurs only under the top roll, the edges of the plate between the bottom roll and the top roll at the beginning and end of forming remain flat even though the plate has been formed into a circular section. To overcome this problem, the plate edges are usually preformed or crimped before forming into a pipe section in the pyramid roll former. Alternatively, the pyramid roll forming method may be practiced by curving the flat edges after the pipe is formed in the pyramid rolls. Other variations of pyramid roll forming have been devised to minimize the flat edge problem. These include offsetting the top roll closer to one of the bottom rolls. This is referred to as the pyramid "pinch" roll method.

The major disadvantage of the various forms of pyramid roll forming are that pipe lengths are limited because the upward deflection of the top roll, which is caused by the upwardly directed forces exerted on the top roll, results in inaccurate forming throughout the pipe length and particularly at the center. The longer the pipe the greater the undesired deflection. Further, the minimum pipe diameter is limited by the top roll diameter. When thick walled pipes are formed the possible pipe lengths are further reduced because greater forming pressures are used with consequent greater upward forces on the top roll. The foregoing disadvantages also limit the production rates of pyramid roll equipment even with skilled operators.

The disadvantages of forming pipes by the pyramid roll forming method have been overcome by the U and O method. This process utilizes heavy press forming as the means of shaping the plate into a circular form. This is done in two separate operations after initially preforming the plate edges a short distance in from each edge to the exact curvature of the finished pipe. First, the plate is forced downward by a punch between two side rolls or dies to form a 'U' shape in a press caleed a U-Press. After the plate has been so formed in the U-Press, it is transferred to an O-Press which contains large hydraulic cylinders or rams that act vertically upon semi-circular dies in the press that force the U into an O-shape. In the O-press a lower semi-circular die is mounted rigidly in the bottom of the press, and an upper semi-circular die is attached to the bottom of the ram so that when the two halves of the dies are brought together, they form a circle the exact size of the pipe. In carrying out the forming operation the top half circular die is raised a sufficient distance and the U shape is conveyed longitudinally into and between the two die halves. When in this position, the hydraulic ram descends with the top half die toward the bottom half die until both die halves come together under immense force to form the U into an O shape.

The U-O method of forming pipes has virtually no limitations as to pipe diameters, lengths and wall thicknesses except for the design limits of the presses. For example, U and O presses have been designed that can produce pipes from 16 inches to 64 inches diameter and up to 60 feet long from 2 inch thick high strength steel plates. Such presses may have hydraulic ram forces totalling over 100,000 tons in order to properly form the steel plate beyond its yield strength.

The U and O method of pipe forming is a highly useful and advantageous pipe forming method and is accepted as a fast and efficient method. However, the forming presses and other required machinery in a U and O pipe mill are extremely expensive. The high capital expense for such equipment can only be justified where there is a market for very large quantities of pipe on the order of several hundreds of thousands of tons of pipe per year. If such tonnage production is not needed the equipment is not economically feasible. Thus the U-O method and mills are not practical where the projected market for pipe, particularly large size wide diameter pipe, is too small to justify the cost of the U and O mill.

Another method for roll forming plate into wide diameter pipe is disclosed in U.S. Pat. Nos. 3,879,994 and 4,428,215 to Hume. This method requires a drum type mandrel which includes a 'Tee' shaped bar that is mounted along the length of the mandrel and projects radially out beyond the cylindrical surface thereof. The Tee bar is so mounted that the space between the Tee bar and the mandrel is slightly greater than the plate thickness to be formed into a pipe. The plate edge is inserted into this space and as the mandrel is rotated upwardly, the plate edge is gripped as the plate bends between the mandrel and the bottom forming roll. The mandrel is rotated at least 180 degrees then reversed for a short distance to release the plate edge. The plate is then conveyed across the machine and the opposite plate edge inserted into the space on the opposite side of the Tee bar. The mandrel is then rotated in the opposite direction until the plate is completely formed. The mandrel is again reversed slightly to release the grip on the plate edge. After forming the section is conveyed lengthwise off the mandrel.

The main disadvantage of this method is that the plate edge entering the space between the Tee bar and the mandrel cannot be preformed to shape because the plate edge must be flat in order to properly grip the edge as the plate starts to bend. Another disadvantage is that the bending forces acting against the mandrel particularly on smaller pipe sizes of standard 40 foot lengths, cause the mandrel to deflect upward which can cause the plate edge to become disengaged with resultant inaccurate forming. Therefore, this method is not satisfactory for producing all pipe sizes, thicknesses, and grades as generally required by the many industries using such products, and particularly the gas and petroleum industries.

The serious problems encountered in using conventional pyramid rolls, that is, linear deflection of the top mandrel, is also encountered in both of the patents. The mandrel or top roll in such installations tends to deflect or spring in a direction away from the workpiece or plate. As the length of the apparatus increases due to the length of the plate to be formed into pipe the deflection becomes more serious and affects the performance of the equipment in properly shaping the pipe. Thus, the length of the pipe to be formed is limited. The present invention is intended to overcome these problems as hereinafter described.

SUMMARY OF THE INVENTION

The present invention is directed to a forming method and apparatus that is considerably less expensive than the U and O method and without the disadvantages of pyramid rolling or other mandrel forming equipment such as described above. Although its capacity may be smaller than the U-O method, the reduced capital cost and high equipment efficiency, as well as the quality of the pipe produced, make the present invention, a very desirable alternative to the U-O method. Plates from which the pipe is formed according to the invention require preforming along each edge in the same manner that is required for pyramid roll forming and U-O forming. However, the O section is completely formed in only one simple machine in contrast to separate U-ing and O-ing presses. The capital cost of a pipe mill using this method can be as low as about one-fourth the capital cost of a U and O pipe mill.

The invention is directed to rolling and forming sections of relatively thick steel plate into pipe and utilizes the principle of a floating mandrel wherein the mandrel serves as the top roll between bottom forming rolls and is so mounted and operated that the plate to be formed is always in full contact with the mandrel and the bottom forming rolls during forming operations. In the usual operation wherein the invention is used pipe sections of relatively long length, for example the standard 40 foot length of the petroleum industry, are formed. Accordingly, the floating mandrel, which is designed to move vertically, or float, in order to cooperate with the bottom forming roll assemblies, as well as the other rolling apparatus employed in such a machine, are relatively long and may extend more than 40 feet in length.

The principal object of the present invention is to overcome undesirable longitudinal deflection problems that occur in machines utilizing the pyramid roll arrangement, and particularly where long pipe sections are formed. By the invention the top forming roll, or mandrel is lowered by support means at its ends until it comes to rest on the plate or other workpiece section to be formed about the mandrel and which plate section is resting on bottom forming rolls. However, instead of applying downward forming pressure only at the ends of the mandrel with resultant upward deflection of the mandrel and uneven contact with the bottom rolls a plurality of top pressure rolls are positioned at the top of the mandrel and apply sufficient downward pressure to the mandrel to prevent upward deflection and counteract the upward forces of the bottom forming rolls and maintain even contact between them and the mandrel. The top pressure rolls are supported by a U-girder extending for nearly the length of the machine and enclosing the lower area of a top girder running from and supported by the frames at the ends of the machine. A plurality of hydraulic cylinders placed along the length of the U-girder and extending from it to the top girder are designed to maintain the U-shaped girder and the mandrel at the level of the bottom forming rolls. The plurality of cylinders are equally spaced along the length of the U-girder and are adjusted so as to compensate for the upward deflection forces and to push up on the top girder.

The foregoing and other objects and features of the invention will be apparent from the following description which includes the drawings described below which disclose a preferred form of apparatus.

DRAWINGS

Figure 1:
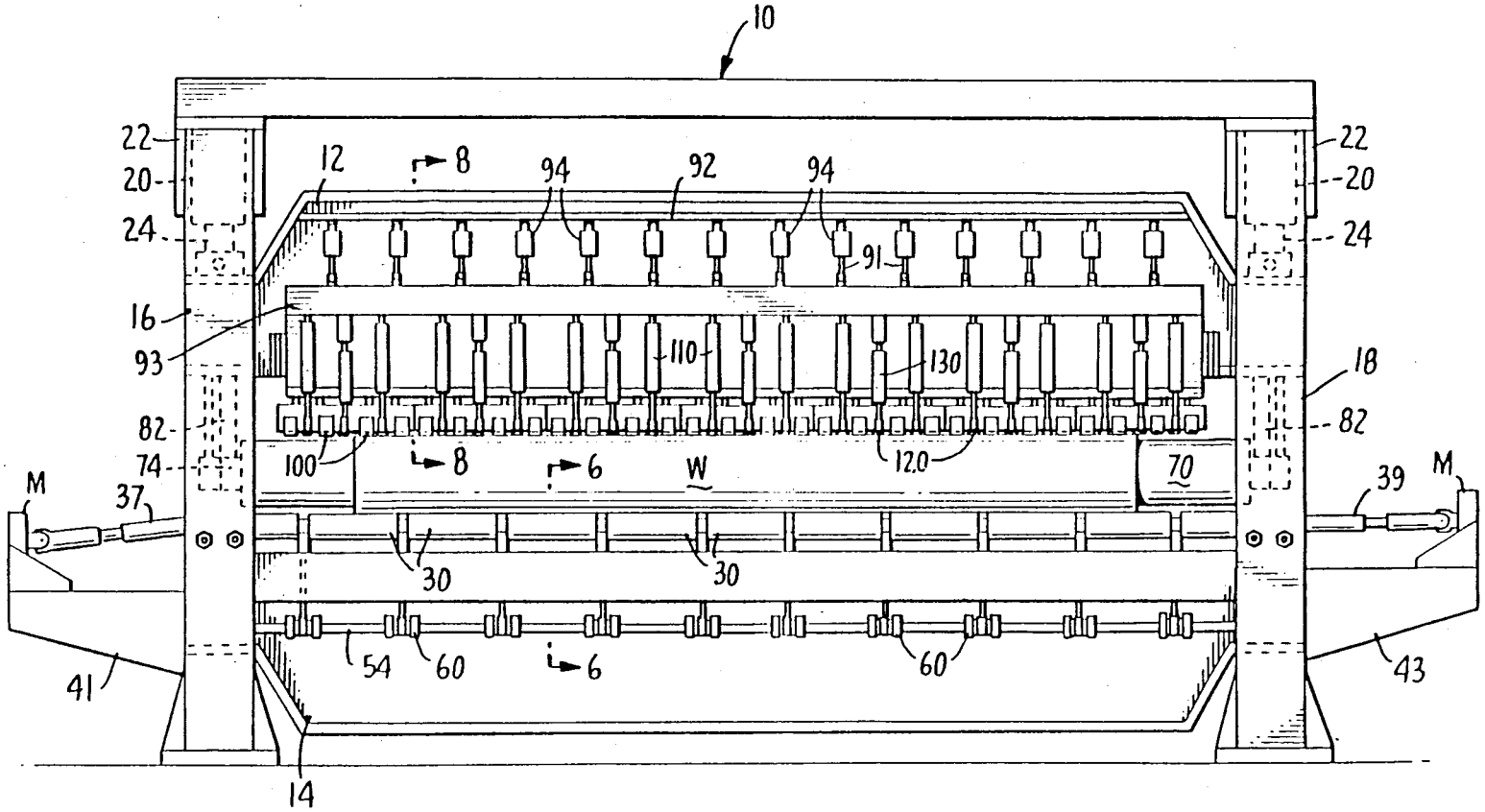
FIG. 1 is a general arrangement in side elevation of the roll forming apparatus of the invention.
Figure 6:
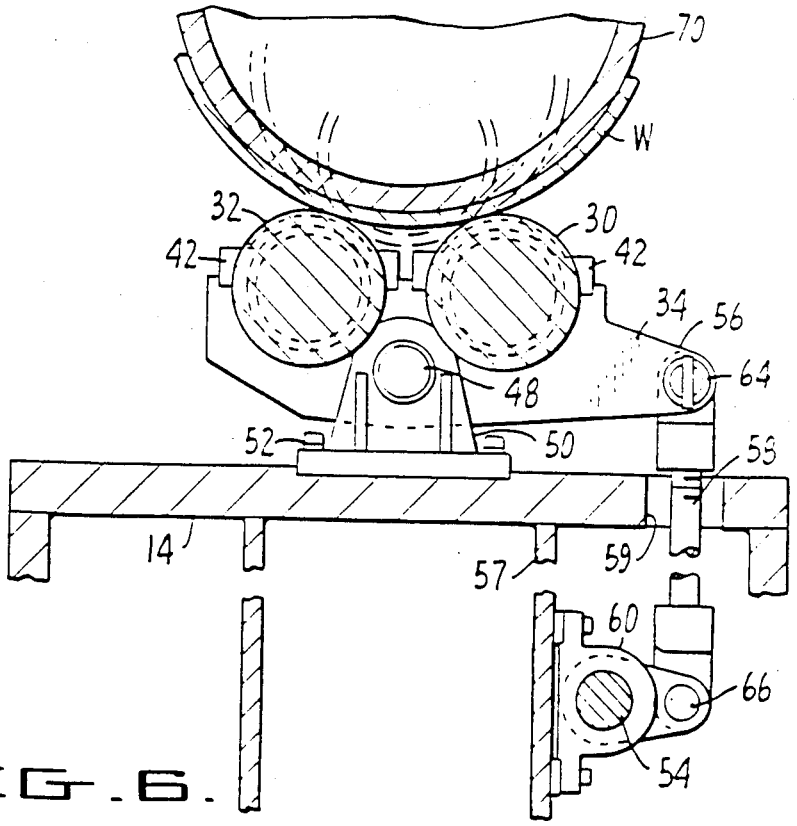
FIG. 6 is a fragmentary sectional view along the line 6—6 of FIG. 1 looking in the direction of the arrows showing the arrangement of the top roll or mandrel and the bottom forming rolls with the formed plate in place between them and the pivotable and adjustable mounting means for said bottom rolls; and also showing in outline the position of mandrels of different diameter.
Figure 8:
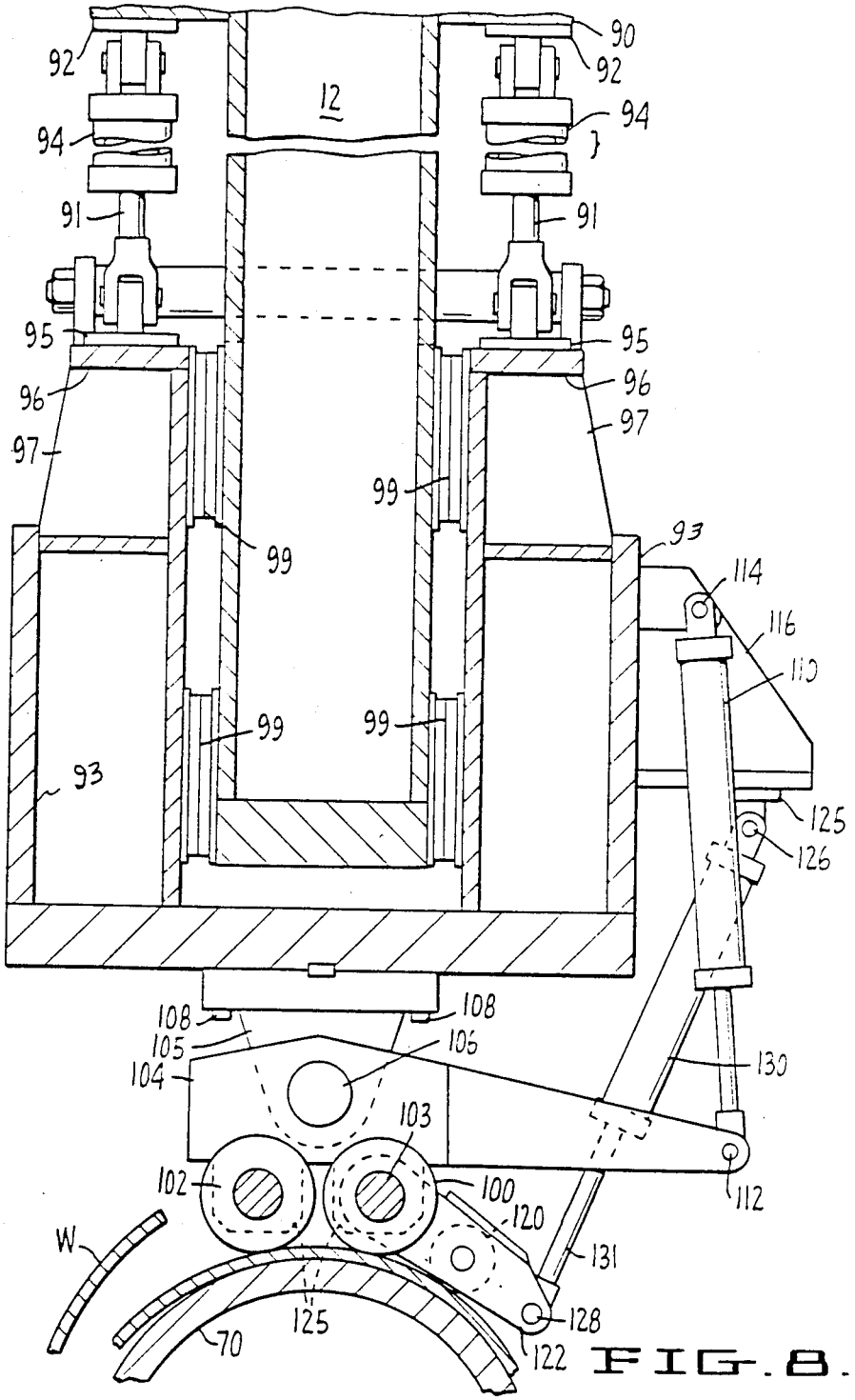
FIG. 8 is a fragmentary view partly in section taken along line 8—8 of FIG. 1 looking in the direction of the arrows and showing a forming mandrel, the top pressure or reactions rolls as pivotably supported and adjustably mounted on the secondary wraparound girder and the top girder.
Figure 9:
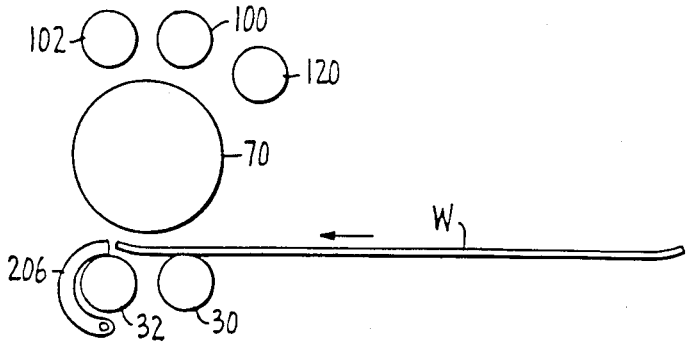
Figure 10:
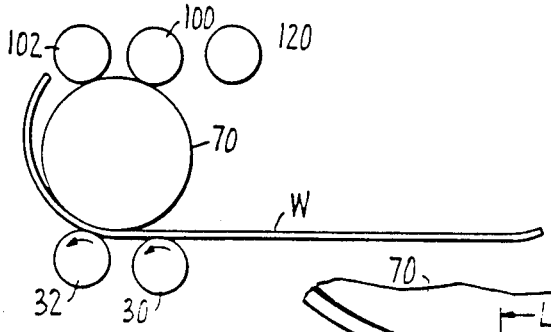
Figure 11:
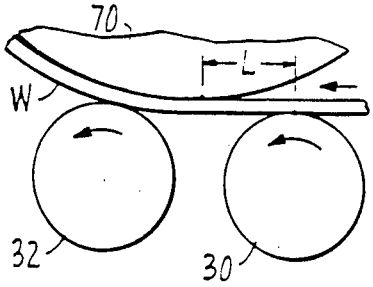
Figure 21:
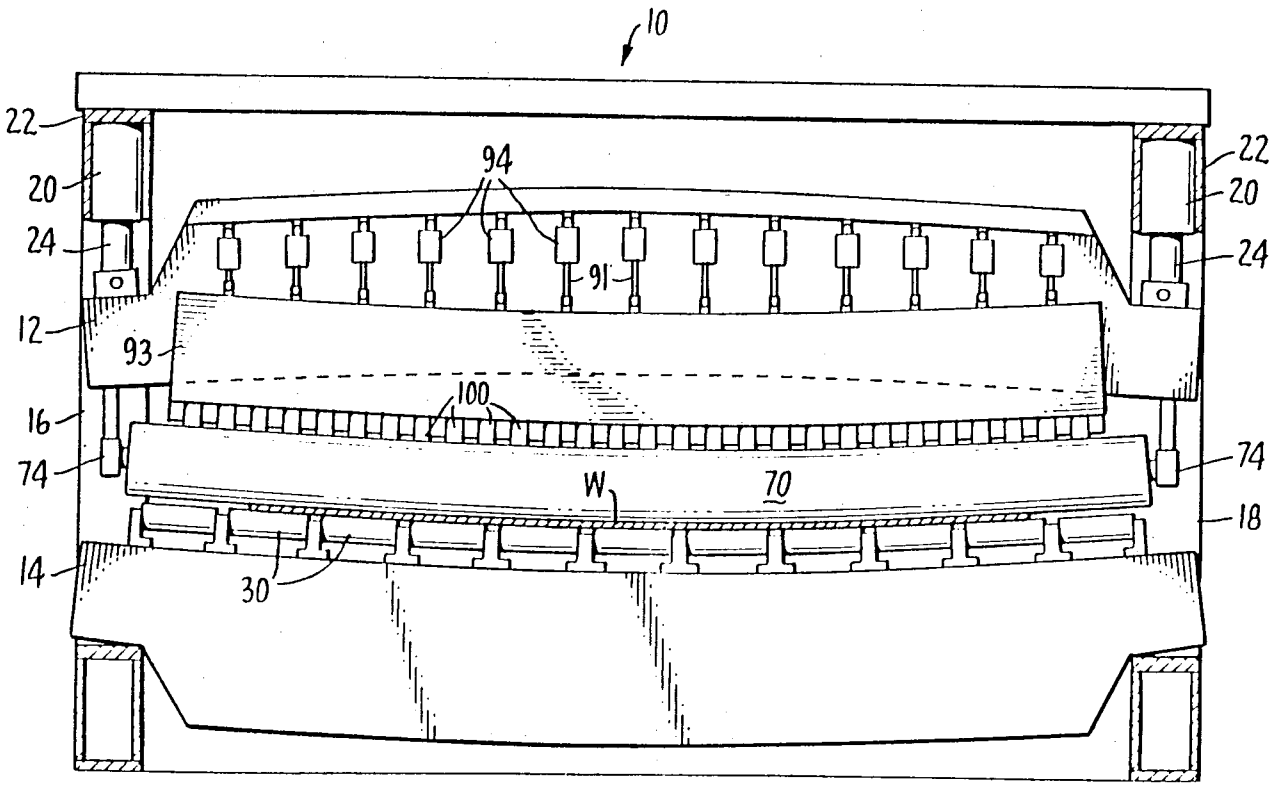
Figure 23:
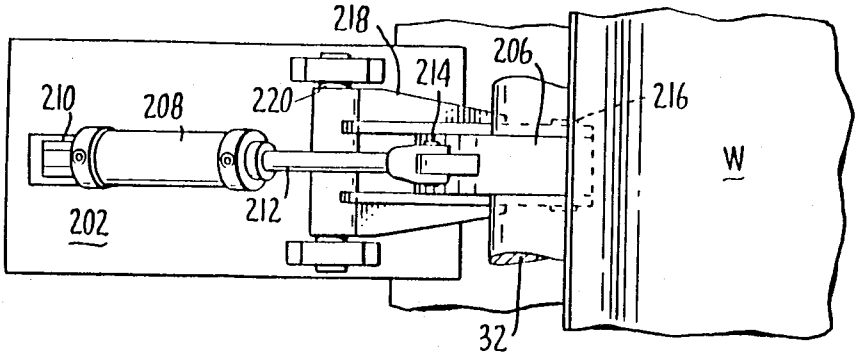
Figure 22:
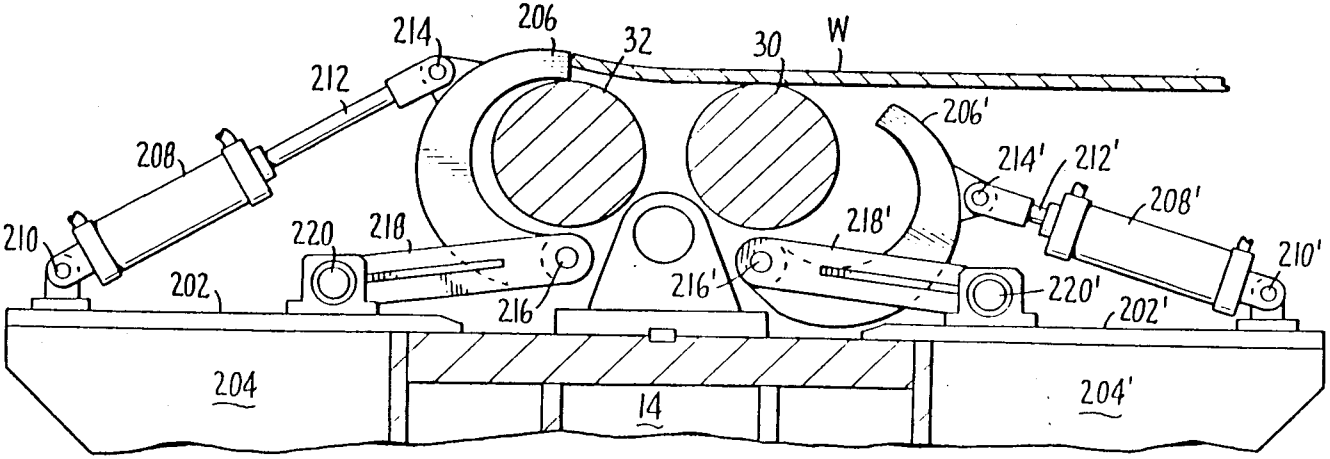
Figures 24, 25, 26:
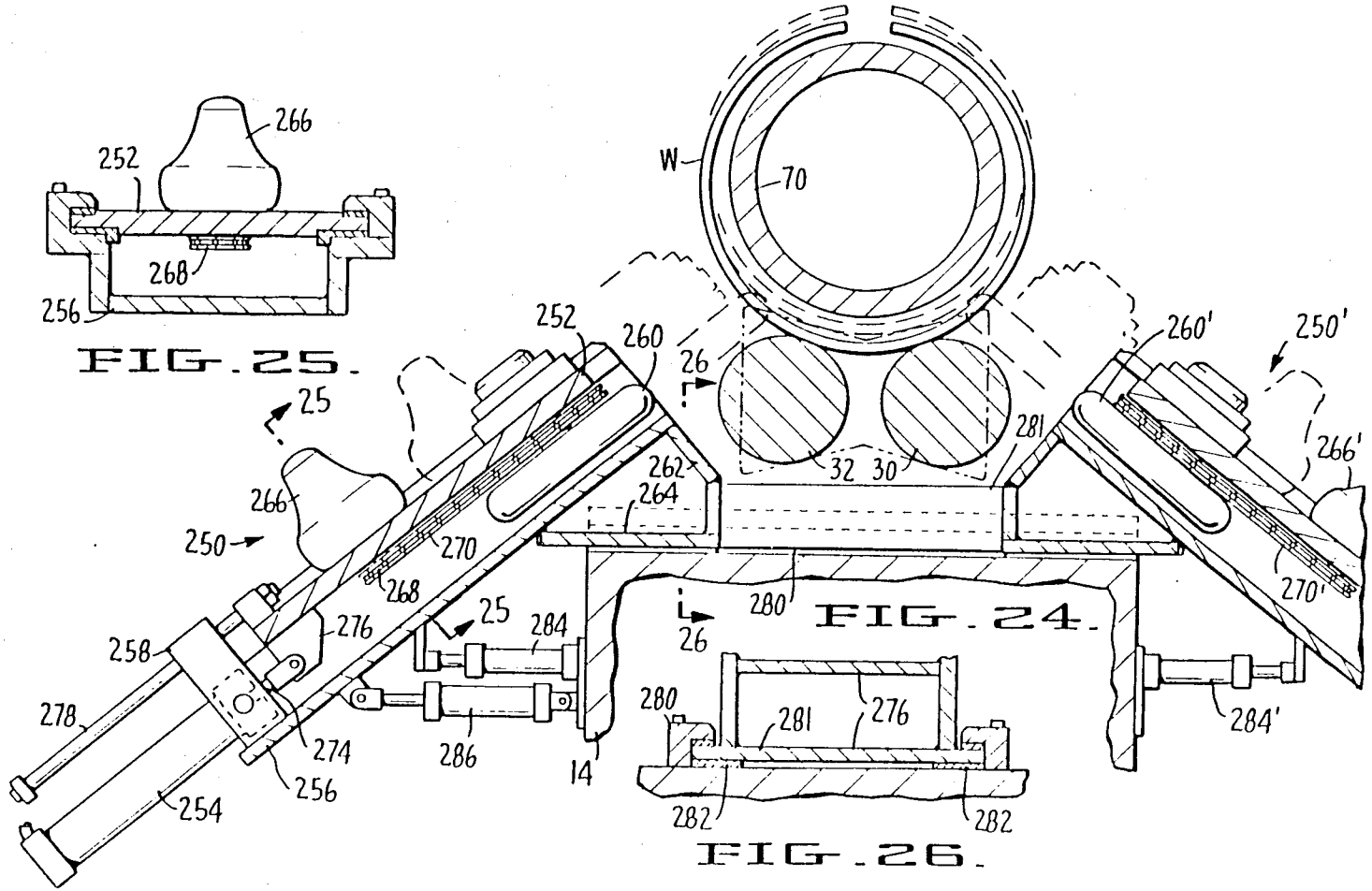
Figure 27:
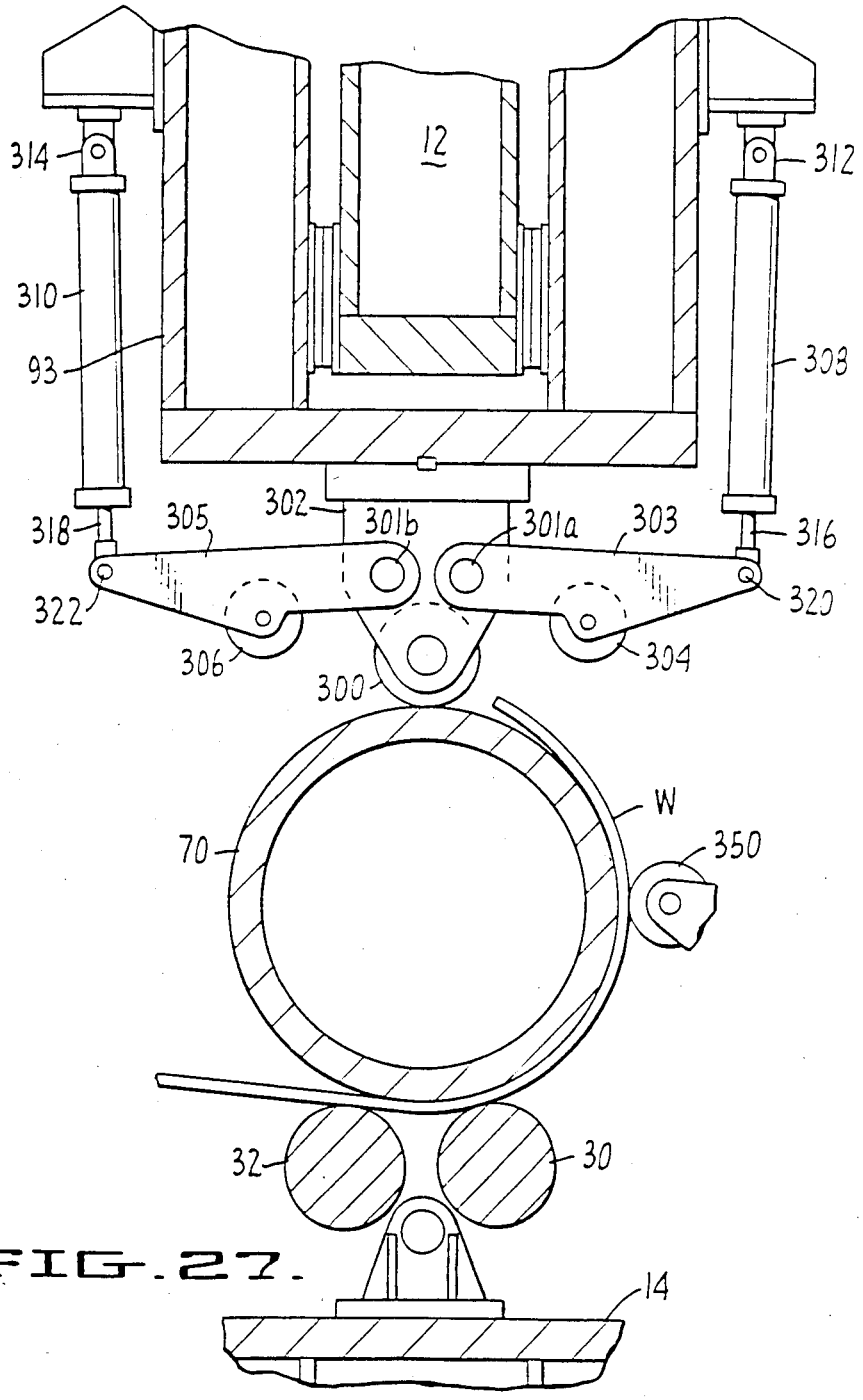
Figure 27B:
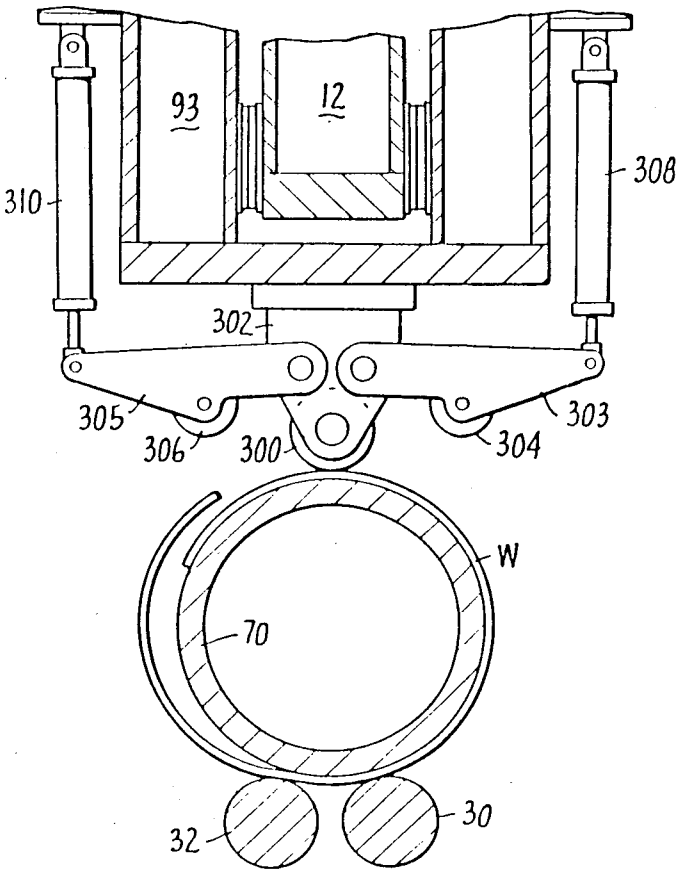
Figure 27A:
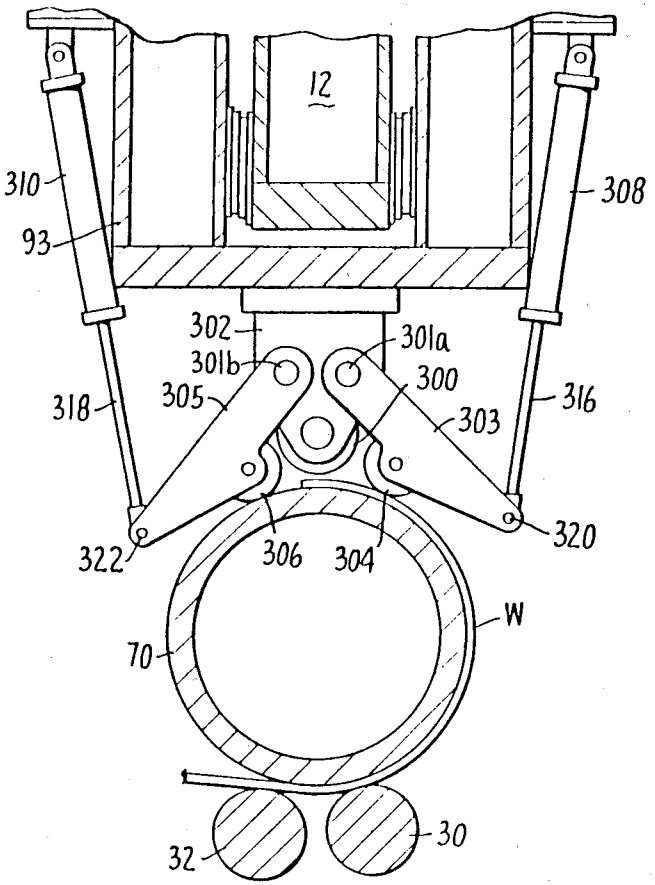
Figure 28A:
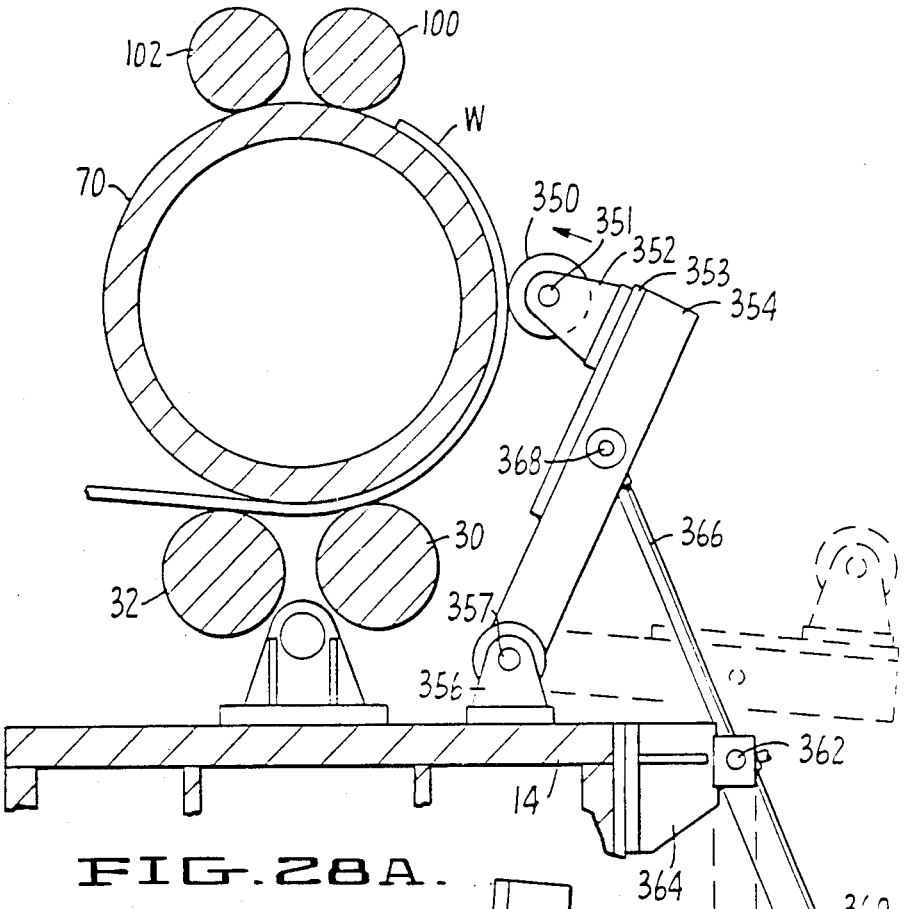
Figure 28B:
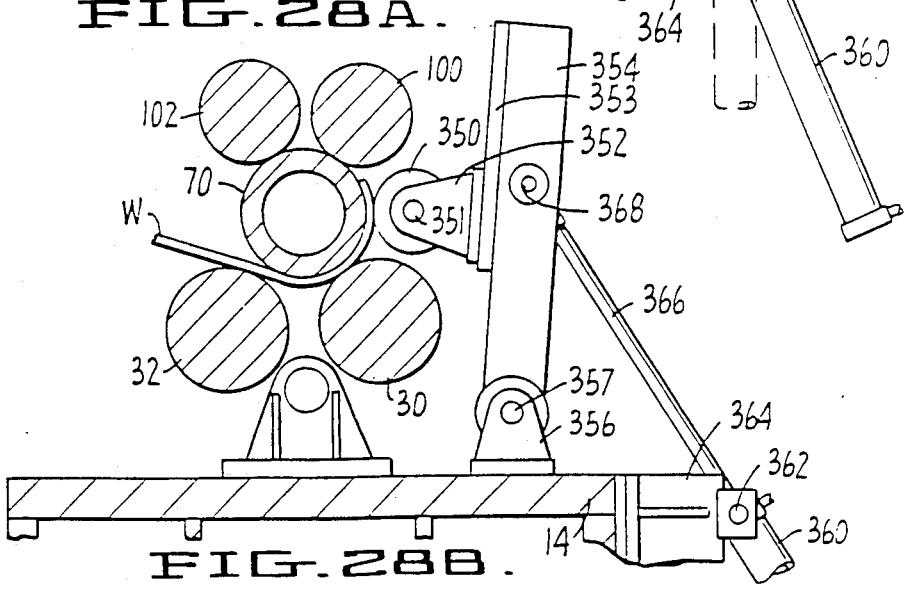

FIGS. 9-11 inclusive are diagrammatic sketches of the positions of the two top pressure rolls, the mandrel and the bottom forming rolls when the workpiece is in those stages of the pipe-forming operation wherein the bottom forming rolls are bending the workpiece in a clockwise direction;

FIGS. 12-20, inclusive are similar sketches wherein the upper pressure rolls, including the springback or gathering roll, are used in the forming operation; and showing the workpiece in its various positions through completion of forming and after the workpiece is rotated so that the edge-gap of the pipe is in the 12-o'clock position for removal from the machine, as well as a cross section of the pipe after the edges have been pressed together and welded;

FIG. 21 is in the nature of a side elevation as shown in FIG. 1 with certain parts of the apparatus omitted and showing in particular and in somewhat exaggerated form the relative positions of the top or primary girder which supports the mandrel, and the secondary wrap-around girder with the supporting hydraulic cylinder means that compensate for the deflection of the top girder and the resultant relatively slight deflection in an opposite direction in the secondary girder, the mandrel and the bottom support girder;

FIG. 22 is a view in section showing the plate stop assembly located on opposite sides of the bottom forming rows at each end of the machine;

FIG. 23 is a top plan view of one of the plate stop assemblies;

FIG. 24 is a view of the pipe exit rolls assembly which is positioned at the exit end of the machine and is shown partly in section and partly in outline when at the operative position;

FIG. 25 is a view partly in section through line 25—25 of FIG. 24 showing the hydraulic motor and moveable frame for actuating the various parts thereof;

FIG. 26 is a sectional view view taken along line 26—26 of FIG. 24 showing the moveable frame for lateral adjustment of the delivery assembly;

FIG. 27 is a view partly in section through a modified form of the machine showing a single main top pressure roll with auxiliary top pressure rolls and wherein the springback roll is repositioned and FIGS. 27A and 27B show the respective positions of the pressure rolls during the forming operation; and FIGS. 28A and 28B are diagrammatic views partly in section of a modified form of the machine shown in FIGS. 6 and 8 wherein the springback or gathering roll is mounted on the bottom girder.

DETAILED DESCRIPTION OF THE PREFERRED EMBODIMENT

As shown in the general arrangement drawing of FIG. 1 the pipe forming machine 10 of the invention comprises a top movable support girder 12, bottom stationary support girder 14, and a pair of end frames 16 and 18 at the opposite ends of the machine. Frame 16 is at the pipe exit end of the machine and frame 18 is at the opposite end. Frames 16 and 18 serve as support means for the machine parts.

Figure 2:
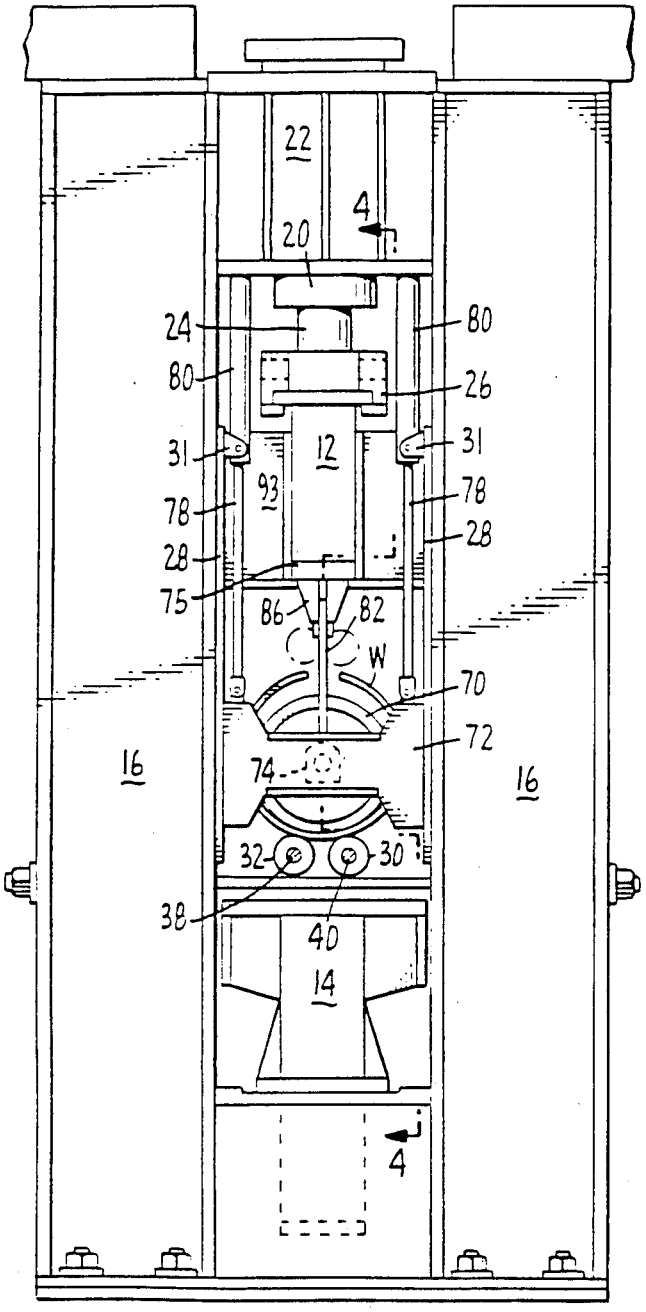
FIG. 2 is a view of that end of the apparatus of FIG. 1 wherein the mandrel is removed and inserted and showing the restraining block for preventing lateral movement of the mandrel, the mandrel itself and the formed pipe.

Hydraulic ram cylinder assemblies 20 are built into the upper crowns 22 of each of the end frames 16, 18 (see FIGS. 1 and 2). Each cylinder assembly 20, includes piston rod 24 connected to top girder 12 through collar and bolt arrangement 26 (See FIGS. 4 and 5). The collar is permanently affixed to the top of girder 12 at ends thereof and in cooperation with cylinder 20 and 24 provide the support for girder 12 and the forces to be exerted by it. The ends of top girder 12 are arranged to be guided vertically between a pair of vertical gibs or grooved guides 28.

A pair of longitudinal parallel bending roll assemblies 30 and 32 comprise the bottom bending roll arrangement and are supported by and rest in pivotable support brackets 34. (See FIG. 6) Roll assemblies 30 and 32 in their preferred form comprise a multiplicity of individual rolls spaced at 48 inch centers. Rolls 30 and 32 are each mounted on common shafts or axles 38 and 40, respectively. Conventional, low speed, high torque, hydraulic motors M are mounted in a frame conveniently supported by and attached to brackets 41 and 43 extending from end frames 16 and 18, respectively. The motors are connected to each end of the bending rolls 30 and 32 by the universal drive shafts 37 and 39.

Figure 7:
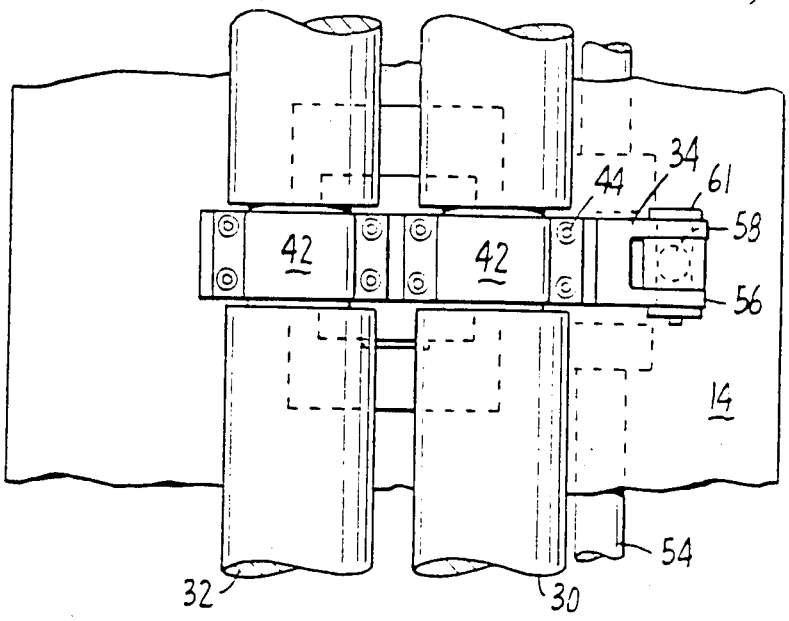
FIG. 7 is a top plan view of a portion of the rolls depicted in FIG. 6 with the mandrel and pipe removed and showing in outline the support means for the bottom rolls.

Several support brackets 34, as above noted, are provided for the roll assemblies 30 and 32 and are supported by journal bearings 42 which are also spaced at the four foot centers along the length of bending rolls 30 and 32 (See FIG. 7). Support brackets 34 pivot on pins 48 at the journals 42 and within stationary supports 50 secured to lower girder 14 by bolts 52 (See FIGS. 6 and 27). One end of each pivotable support bracket 34 is connected to a longitudinal torque shaft 54 through a bell crank arm extension 56 and an adjustable tie rod assembly 58 extending through opening 59 to assure that all pivotable support brackets 34 pivot in unison throughout the length of the roll assemblies 30 and 32 along the length of the machine. Longitudinal torque shaft 54 rotates in journal bearings 60 which are securely attached to the side wall 57 of bottom girder 14 at the same longitudinal points on the machine as each pivotable support bracket 34. (See FIGS. 1 and 6).

The connecting assembly that includes adjustable tie rod 58 is pivotably connected by pin 64 to support bracket 34 and at its opposite end by pin 66. In the disclosed embodiment the length of tie rod 58 can be changed by adjustment of the threaded portion thereof at the end adjacent pin 64.

One of the essential and unique features of the machine of the present invention is the floating mandrel 70, which corresponds to the top roll in a pyramid roll arrangement. In operation it is intended to contact the workpiece to be formed as the workpiece rests on bottom forming rolls 30 and 32. Mandrel 70 cooperates with the bottom forming rolls, as will be further explained, as the formed plate is bent around the mandrel between the bottom forming rolls 30 and 32. Mandrel or top roll 70 must be and is a single roll. It is mounted in the machine, as more fully explained below, so that rolls of different diameters can be employed as the requirements for differing pipe sizes change.

Figure 3:
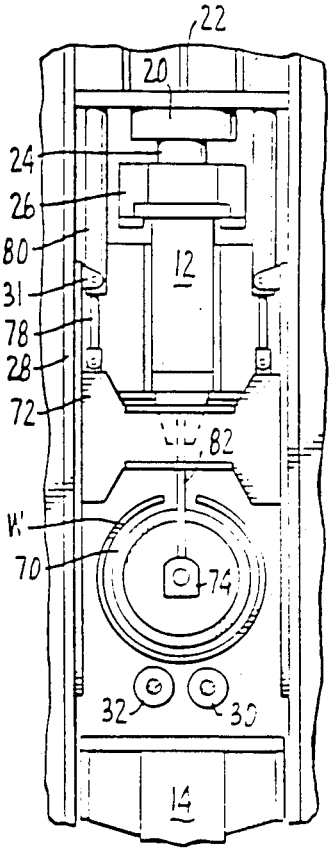
FIG. 3 is a fragmentary view of the same end of the apparatus wherein the restraining block for the mandrel is elevated and in an open position.
Figure 4:
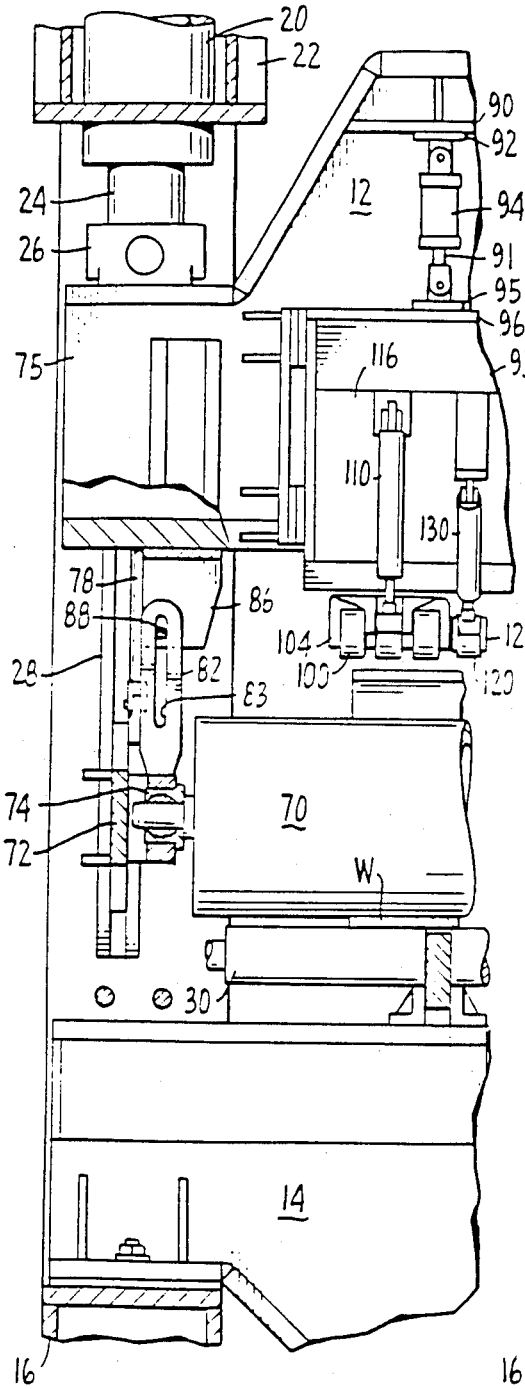
FIG. 4 is a broken-away view of the end of the apparatus shown in FIG. 2 as viewed in side elevation and as taken along the line 4—4 of FIG. 2 looking in tbhe direction of the arrows.
Figure 5:
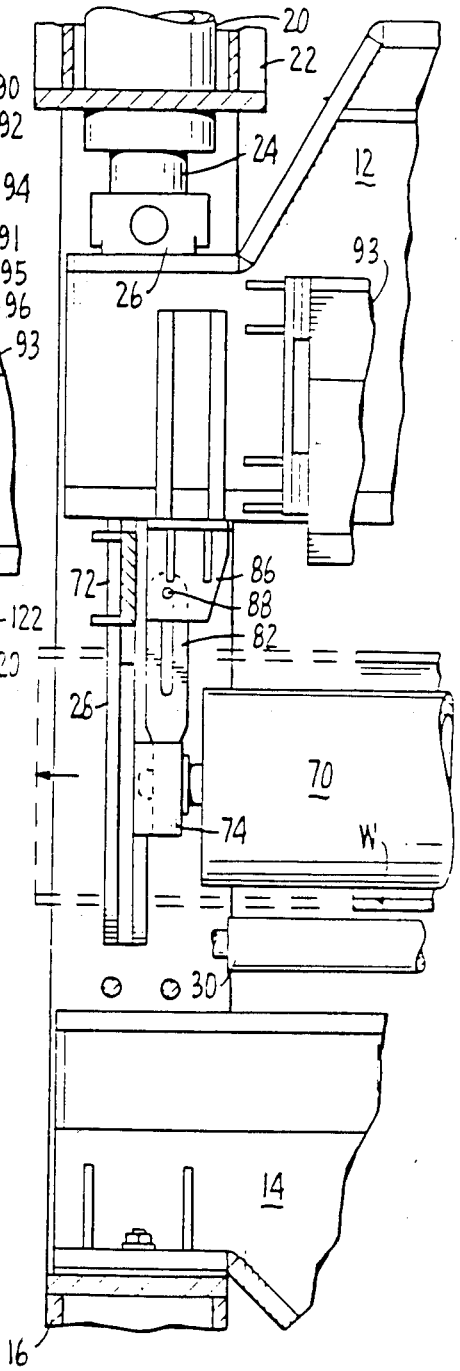
FIG. 5 is a similar view of the same section of the apparatus as shown in FIG. 4 and showing the restraining block for the mandrel in a raised position as shown in FIG. 3.

Mandrel 70 is normally positioned at each of its ends in bearing 74 adjacent to restraining blocks 72 which prevent horizontal or lateral movement of the mandrel. The restraining blocks 72 are located in frames 16 and 18 at each end of the machine. The restraining block at the exit end of the machine slides vertically up and down within guides or gibs 28 in the walls of frame 16 (FIGS. 2, 3 and 4). A pair of vertically disposed hydraulic cylinders 80, positioned above the mandrel in the frame 16 at the entry and exit end of the machine each have rods 78 arranged to raise and lower restraining block 72. Cylinders 80 are each suspended from brackets 31 extending from the top of gib 28. Accordingly, when block 72 is raised to its uppermost position within end frames 16 the end restraint is removed and the machine is open to permit the pipe-shaped form about mandrel 70 to be withdrawn through frames 16. Also, when the end of the machine is opened in this manner and pin 88 is removed from the mandrel supporting lifter blades 82 the mandrel may be changed, for example to insert a mandrel of a different size.

At each end of mandrel 70 support bearings 74 are connected to ends 75 of top beam or girder 12 by lifter blades 82 which are connected to and extend upwardly from the outer covering of mandrel bearing 74 to webs 86. Lifter blades 82 include a slot 83 through which pin 88 extending from web 86 is arranged to slide (FIGS. 4 and 5). Each lifter blade 82 has a long vertical slot in it to allow pin 88 to continue to travel down with top girder 12 after mandrel 70 has come to rest on plate or workpiece W which is supported by bottom rolls 30 and 32. As heretofore described the vertical movement of top girder 12 is controlled by cylinder assemblies 20 so that the vertical movement of floating mandrel 70 is thus effected through the cooperation of the lifter blade assembly just described.

A U-shaped secondary girder 93 envelops or is wrapped around, the underside of top girder 12 and extends the length of the machine between end frames 16, and 18. The U-shaped girder 93 is supported and its movement is controlled by a plurality of hydraulic pressure cylinders 94 located on both sides of top girder 12. Cylinders 94 are connected at their upper ends to upper horizontal flange 90 extending from and along the length of girder 12 and are each seated on upper intermediate base plate and pin assemblies 92. At their opposite ends cylinders 94 are connected to U-shaped secondary girder 93 by means of pivot brackets and base plates 95 mounted on horizontal flanges 96 are of U-girder 93. Flanges 96 have suitable reinforcing means or gussets 97.

Attached to the bottom of U-shaped secondary girder 93 which is wrapped around girder 12 and guided by sliding gibs 99, are two parallel rows of pressure rolls 100 and 102. The wall thickness of mandrel 70 must be sufficiently heavy to withstand forming pressures exerted upon them by the top pressure rolls 100 and 102 which are mounted on pivotal brackets 104 and bottom forming rolls 30 and 32 mounted on pivot brackets 34. Brackets 104 pivot in much the same manner as heretofore described in connection with bottom roll assemblies 30 and 32 and pivotal support bracket 34. Bracket 104 pivots on pin 106 and within stationary supports 105 fastened by bolts 108 to the underside of U-shaped secondary girder 93. Bracket 104 may be actuated by a plurality of cylinders 110 connected by pin 112 and at the other end to U-shaped secondary girder 93 by pin 114 and bracket 116 extending from and fastened to the side face of girder 93.

Springback control roll 120 (FIG. 8) is supported by arm 122 which pivots about spindle 103 at the journal supports 125 for pressure roll 100 and is actuated by cylinder 130. Cylinder roll 130 is fastened to the underside of bracket 116 which extends from U-girder 93, by pins 126 at the upper end thereof and at its opposite end by rod 131 attached by pin 128 to supports 122 for springback rolls 120.

Another arrangement for the mounting of springback roll means is disclosed in FIG. 28 and is described hereinafter.

As in the case of bottom roll assemblies 30 and 32, top rolls 100 and 102, and springback roll 120 can each be a single roll extending the length of the machine, or they may comprise multiple units or assemblies of individual rolls of short length that are arranged so as to operate in unison.

The foregoing describes and identifies the principal parts and mechanisms of machine 10 with the exceptions of the plate stop assembly, the pipe exit delivery means and the hydraulic systems employed in the operation of various parts of the machine. The operation of the entire combination for the purpose of forming pipe is described below.

The large hydraulic cylinders 20 connected vertically to top girder 12 at each end thereof within frames 16 and 18 may be actuated to move upward or downward as desired and thereby adjust the vertical position of top girder 12 from which floating mandrel 70 is suspended. An exact predetermined position is normally maintained for each pipe size to be formed in order to produce a satisfactory cylindrical form to all conditions. The proper mandrel diameter(s) for each pipe size to satisfy all variables may be readily determined by those skilled in the art. The combined downward force of the two main hydraulic cylinders 20 acting upon the ends of top girder 12 and the cooperating position cylinders 94 which cooperate with U-girder 93 provide the roll pressures essential for the forming operation.

Pressure rolls 100 and 102 are each connected to U-shaped girder 93 through cooperating pivotable support brackets 104 and cylinder 110 and connecting pivot bracket 105 positioned approximately on the same center line as mandrel 70 to be described below. U-shaped girder 93 is in turn connected to top girder 12 through a series of position cylinders 94.

Pressure cylinders 94 are designed to have sufficient stroke and to apply sufficient force so that when they are extended they force U-shaped girder 93 downward causing pressure rolls 100 and 102 to bear upon mandrel 70 and causing mandrel 70 to move downward with sufficient force to bend the plate W between bottom forming rolls 30 and 32.

Pressure cylinders 94 must also have sufficient stroke, i.e. length, so that they never reach the end of their full stroke when they are extended under full load as above described wherein pressure rolls 100 and 102 are in contact with mandrel 70 and mandrel 70 is in contact with bottom bending rolls 30 and 32 while taking into account the upward deflection of top girder 12 and the downward deflection of bottom girder 14. Furthermore, pressure cylinders 94 must move upward sufficiently without reaching the end of their retracted stroke when top pressure roll brackets 104 are fully pivoted so that the centers of pressure rolls 100 or 102 are on the vertical centerline of the machine which vertical centerline passes through top pivot bracket pin 106 and bottom pivot bracket pin 48 with plate W between the mandrel 70 and bottom bending rolls 30 and 32 and with Plate W between mandrel 70 and top pressure rolls 100 or 102 in the pivoted position just described.

Hydraulically actuated springback rolls 120 are attached to and move with the U-shaped girder 93 as heretofore described and shown in FIG. 8. Rolls 120, when in the working position, serve to bring the formed leading edge of the plate W back into contact with the mandrel 70 so that the leading edge of the plate can pass pressure rolls 100 and 102 and mandrel 70 as the partially formed plate continues to progress into the bottom rolls 30 and 32.

There is at least one floating mandrel for each pipe size. These mandrels are thick walled cylindrical devices the length of which are the maximum pipe length to be formed plus approximately two feet beyond each end of such pipe. The surplus length of the mandrel that extends beyond the pipe ends, extend into openings at the frame ends 16 and 18. The journals 74 and lifter blades 82 with their slot and pin assemblies guide the mandrel 70 vertically and allow it to float vertically within the frame 16, 18 while restraining blocks 72 prevent lateral movement of the mandrel along its axis. Each mandrel diameter is selected for proper overforming of the plate W as it is formed by bottom forming rolls 30 and 32 and the mandrel 70 so that when the plate springs open after forming, the formed cylinder or pipe (see FIGS. 18 and 19) will have a diameter slightly larger than the finished diameter of the finished pipe. Springback after forming will vary with the thickness of the plate, its physical characteristics, and with each pipe diameter, in order to produce a satisfactory cylindrical form to all such conditions, the proper mandrel diameter(s) for each pipe size to satisfy all variables is readily determined by those skilled in the art. However, the mandrel wall thickness must be sufficiently heavy to withstand forming pressures exerted upon them by the top pressure rolls 100 and 102.

The operation can be further understood by reference to FIGS. 9 through 20.

A new plate or workpiece W with its edges already preformed to the desired final diameter of the pipe is conveyed laterally into the machine along a conventional table or like means, not shown, and enters the machine as shown in FIG. 9. Plate W is stopped by the assembly of FIGS. 22 and 23, the structure of which is described hereinafter, with its leading edge above forming roll 32 and rests on forming roll 30. Both forming rolls 30 and 32 are power driven in either direction. Top girder 12 with mandrel 70 suspended from it at each end by retractable lifter blades 82 as shown in FIGS. 2 through 5 descends so that mandrel 70 is lowered and comes to rest on the plate. Girder 12 continues downward until it stops at a pre-determined position as pressure cylinders 94 are depressed and rods 91 move upward about 3 inches while under low hydraulic pressure acting downward. After top girder 12 stops while cylinders 94 are so depressed, hydraulic pressure is increased in pressure cylinders 94 and thereupon exert sufficient downward force upon the mandrel 70 by means of the top pressure rolls to cause the plate W to bend between forming rolls 30 and 32 until the preformed edge of the plate W is pressed firmly against mandrel 70 by forming roll 32. Forming roll 30 will then bear upward on the the unformed portion of the plate W resulting in a lever arm "L" between point 'a' on the mandrel and point 'b' where the plate W contacts roll 30 (FIG. 11). The stop assembly is retracted and forming rolls 30 and 32 are then rotated in a counterclockwise direction as the plate W moves forward and rotates in a clockwise direction and bending occurs in the unformed portion of the plate W at point 'a'. As the newly formed portion of the plate moves to the left hand side of point 'a', it is pressed firmly against the mandrel 70 by forming roll 32 as forming continues in a clockwise direction about the mandrel until the left-hand edge of the plate is formed upwardly about the mandrel where it is stopped near pressure roll 102 as shown in FIG. 10. Since the distance between the mandrel 70 and the forming roll 30 is greater than the distance between the mandrel and forming roll 32 when forming the plate in a clockwise direction, forming roll 30 will rotate downward and away from mandrel 70 as the brackets 34 in which both forming rolls are mounted pivot on pin 48.

While the top girder 12 is designed rigidly to safely resist all upward forming pressures, it will nevertheless deflect or spring upward slightly under load. Likewise, the bottom girder supporting the forming roll will spring downward. This combined deflection, if not compensated for, would cause irregular forming throughout the pipe length. This is compensated for, however, by allowing the top pressure rolls 100 and 102 to exactly follow the bottom 14 to the extent it may deflect. Although girder 12 deflects upward along its length, due to the upward forces of cylinders 94, which are placed between top girder 12 and U-shaped girder 93, U-girder 93 follows bottom girder 14 and top pressure rolls 100 and 102 attached to the bottom of 93 and assumes the same curvature. Since cylinders 94 are uniformly distributed between the top of U-shaped girder 93, and under the flange 90 of the top girder 12, the pressure rolls 100 and 102 bearing upon mandrel 70 will follow the deflection of the bottom girder 14 and thus cause uniform bending of the plate throughout its length.

Figure 12:
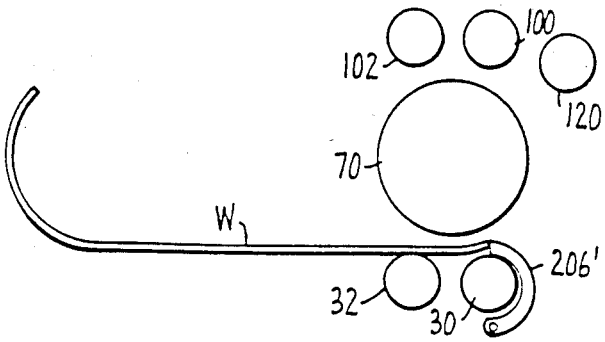
Figure 13:
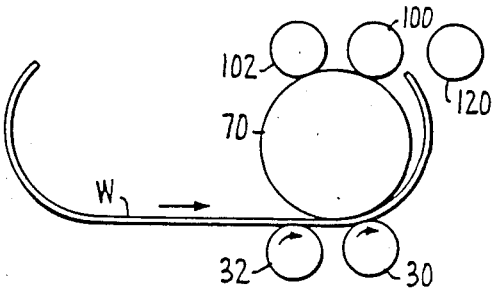
Figure 14:
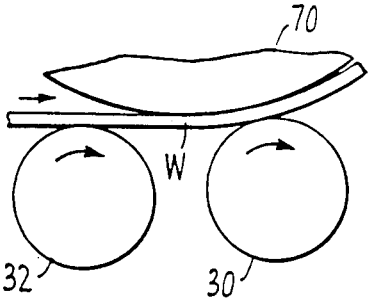

After the left-hand side of the plate is formed with the rolls in the position as, and to the extent, shown in FIGS. 10 and 11, the forming rolls 30 and 32 are stopped. Top girder 12 is raised with mandrel 70 to clear the partially formed plate which is then conveyed further to the left until the preformed right-hand edge of the plate is over the center of forming roll 30 as shown in FIG. 12. Top girder 12 and mandrel 70 are lowered to the same predetermined position heretofore described for forming the left side of the plate. Top pressure rolls 100 and 102 are again firmly pressed against mandrel 70. In this position, bottom forming rolls 30 and 32 are actuated once again, except in a clockwise direction, and exert forming pressure upward upon the plate W. Forming roll 30 forces the right-hand preformed plate edge against the mandrel 70 as the flat portion of the plate is bent toward forming roll 32. Since bending cannot occur without leverage between pressure points of contact as previously described, the upward force of roll 32 and the downward reaction of the mandrel 70, a gap of space will automatically be maintained between the upper plate surface and the mandrel 70 above forming roll 32 (See FIG. 14).

Figure 15:
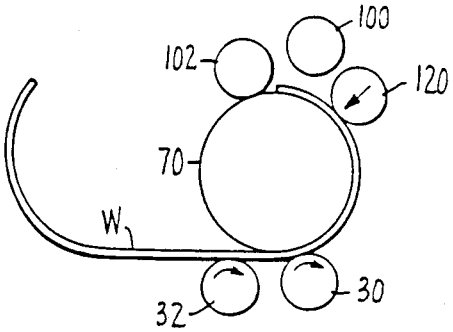
Figure 16:
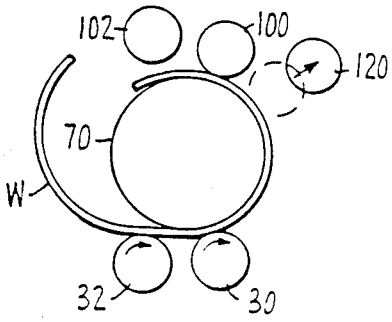

As the forming rolls are turned in a clockwise direction (FIG. 13), the right-hand side of the plate will form uniformly upward in a counterclockwise direction as the right-hand plate edge passes between mandrel 70 and springback rolls 120. At this point springback roll 120 is actuated by hydraulic cylinder 130 as heretofore described and moves toward mandrel 70 as it pivots about spindle 103 so as to force the leading plate edge against the mandrel as the plate edge continues to move up and over the mandrel passing between the mandrel 70 and pressure rolls 100 and 102 (FIGS. 15, 16 and 17) while exerting forming pressure through the mandrel 70 against forming rolls 30 and 32. Thus, forming pressure is maintained consistently as the load is transferred from roll 120 to pressure rolls 100 and 102 (FIGS. 15, 16 and 17).

As the right side of the plate continues to be formed, the previously formed left side of the plate advances toward the mandrel 70. As the bottom of the previously formed surface comes into contact with forming roll 32, roll 32 will move upward as the formed surface passes over it while exerting a constant upward pressure as the remaining flat surface between the bottom of mandrel 70 and forming roll 32 is formed. During this phase, the previously formed left side of the plate progressively closes the gap between forming roll 32 and the mandrel until the plate comes into contact with mandrel 70 as shown in FIG. 17. At this point, forming is complete with the right edge of the formed plate tucked inside the left-formed side of the plate with the balance of the plate still held in intimate contact with the mandrel 70.

Figure 17:
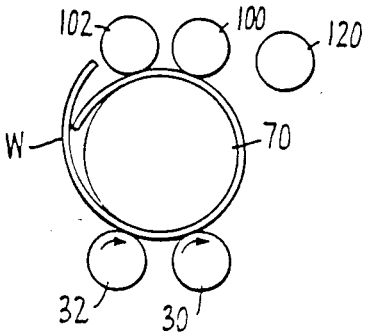

The forming rolls are stopped when the formed plate is approximately in the position as shown in FIG. 17.

Figure 18:
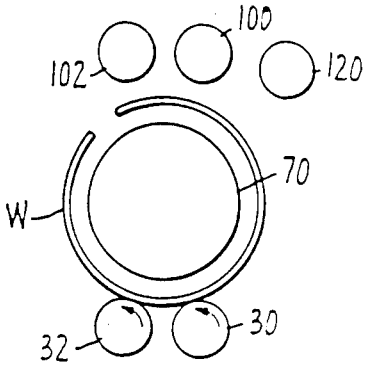
Figure 19:
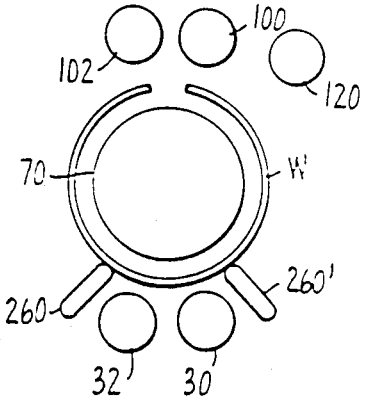
Figure 20:
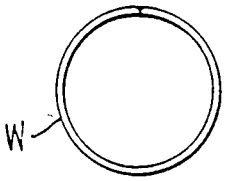

Hydraulic pressure is then reduced in pressure cylinders 94 as previously described and top girder 12 is raised by cylinder 20 along with cylinders 94, U-girder 93, and top rolls 100 and 102. The formed plate will spring open as the top girder 12 continues upward to a predetermined stop position, and mandrel 70 is raised with it to clear the inside of the formed pipe as shown in FIG. 18. In this position, the gap between plate edges will be considerably to the left at approximately a 10-o'clock position. The mandrel 70 is supported in its raised position by lifter blades 82 and the pipe is rotated clockwise from the FIG. 18 position to the 12 o'clock position shown in FIG. 19. Restraining block 72 which normally prevents horizontal movement of the mandrel 70, as shown in FIG. 2, is raised to the position shown in FIG. 3 to allow the formed pipe to be removed from the machine between end frame members 16. The gap between the plate edges will pass over the lifter blade 82 supporting the mandrel as the formed pipe is conveyed out of the machine on powered rolls as hereinafter described. The pipe form is then ready for seam welding to the shape as shown in FIG. 20.

The operation of the invention is facilitated by the use of a plate stop means. Although various means can be used for this purpose, one form of a satisfactory plate stop is shown in FIGS. 22 and 23. It is intended to be placed at positions adjacent the bottom forming rolls whereby the incoming plate to be formed, or the partially formed plate that is to be further bent to the final shape, may be halted and properly positioned as it moves on the conveyor tables prior to the bending operations. In FIGS. 22 and 23 the assembly may be positioned at approximately one-fourth of the length from each of the plate on each side of the machine so as to accomodate both standard and shorter lengths of pipe. The apparatus will be described as shown in the left side of FIG. 22 and the top plan view of FIG. 23. As will be noted by reference to these figures the assembly is mounted on a platform 202 and gusset 204 both of which are affixed to and supported on one end of bottom girder 14.

The stop assembly includes a latch 206 actuated by a hydraulic cylinder 208 which pivots at bracket support 210 mounted on the outer end of 202. Rod 212 extending from the cylinder at its opposite end is pivotally connected at 214 to hinge latch 206. Latch 206 at its opposite end connect with arm 218 which is also pivotally supported on platform 202 at 220.

When hydraulic cylinder 208 is actuated as shown in FIG. 23 rod 212 is extended to position 206 in an upright location immediately above the midpoint of roll 32. The leading edge of hinge 206 has sufficient surface to impinge upon and arrest the forward movement of plate W when it is received from the conveyor tables prior to forming.

When the forming operation is to commence cylinder 208 is actuated to retract rod 212 and thereby remove hinged stop or latch 206 to move it to the downward position so that when the rolls 30 and 32 and mandrel 70 (not shown) are actuated the plate is free to move forward as the bending operation commences.

In like manner the aforedescribed operation is repeated by the corresponding apparatus on the opposite side of the assembly just described. The parts are identical and bear the same numbers in the prime system, i.e. 202' though 220' as just described. Desirably, two pairs of plate stop assemblies are used to assure ease of lining up the plate before the forming operations commence. Although they are not shown in FIG. 1 or any of the other assembly drawings, they are positioned at advantageous points along the length of the machine as heretofore stated.

Various types of pipe exit units may be used in the machine. A preferred form of pipe exit unit is disclosed in FIGS. 24, 25 and 26. It is intended to be positioned adjacent the exit end of the machine at approximately 45° from the vertical center line of the respective rolls 30 and 32. As will be noted from FIG. 24 the exit assembly comprises essentially identical units disposed on opposite sides of the assembly. Only one unit of the assembly will be described in detail and corresponding parts are identified by corresponding prime numbers on the opposing unit.

Each unit 250 comprises a slidable frame 252 actuated by hydraulic cylinder 254 mounted in support guide 258 and having rolls or wheels 260 at the opposite end of the frame adjacent to the pipe forming machine. Bottom frame 256 has supporting plates 262 running from the end adjacent the roll and which plate elements are integral with and supported by horizontal plate 264 which slides on the top of lower girder 14 through guides 282 (FIG. 26).

The slidable plate 252 includes a hydraulic motor 266 mounted on its outer side and which extends through plate 252 and is attached to sprocket 268 (FIG. 25). Roller chain 270 is fastened to sprocket 268 and runs under plate 252 and about a similar sprocket between roll 260 and plate 252 both of which are connected to plate 252. In operation after completion of forming of a pipe on the machine 10 and rotating it to the 12 o'clock position hydraulic cylinder 254 is actuated and rod 274 fastened to rod eye 276 beneath plate 252 is actuated and the plate is moved forward to the position shown in the dotted lines in FIG. 24. Stroke limiter rod 278 assures that plate 252 carrying roll 260 will move a predetermined distance for a given pipe size (see FIG. 24). Accordingly, after plate 252 has contacted the pipe to be removed and wheel 260 has lifted the pipe, motor 266 is started to actuate roller chain 270 and rotate wheel 260 so that the combined effect of the opposing wheels 260 and 260' on each of the cooperating units 250 and 250' has the effect of lifting the pipe and moving it out of the machine.

The opposing pipe exit units 250 and 250' are joined by frame members 280 and 281 mounted on sidewalls 262. These frame members also interfit in guides 282 and are held centered by the pair of centering piston units 284 and 284' fastened to the sidewalls of girder 14. An actuating cylinder 286 will move units 250 and 250' laterally within a predetermined distance of about 3 inches in each direction to thereby assure that the gap in the pipe will pass the lifter blade units 82 which otherwise might interfere with the removal of the pipe from the machine. It is to be understood that the opposed unit 250' located on the other side of the pipe section in FIG. 24 is actuated in a similar manner.

Advantageous modified forms of the top pressure roll arrangement and of the springback roll arrangement of the invention are disclosed in FIGS. 27 and 28, respectively. As will be noted in FIG. 27 the top pressure roll assembly comprises a single set of rolls 300 mounted at the center line of the machine on support bracket 302 attached to the bottom side of U-shaped girder 93. This assembly serves as the primary pressure roll to force the mandrel 70 to maintain proper pressure and contact with rolls 30 and 32 by means of pressure cylinders 94 and the effect they exert on U-girder 93 to insure even forming of plate W. The other principal modification of the apparatus described in FIG. 8 is the provision of the different modified pivotal bracket arms 303 and 305 which are mounted on separate spindles 301*a* and 301*b* through conventional journals as heretofore described at spaced points along the length of the roll assembly in separate sections. Pivotable bracket arms 303 and 305 each have mounted on them separate rolls 304 and 306 with suitable spindles. These rolls are adapted to be moved into contact with the workpiece being formed and to cooperate with the principal pressure roll as required as further explained below. The movement of bracket arms 303 and 305 which assist in this operation are controlled by hydraulic cylinders 308 and 310 which are suspended from each side of U-shaped girder 93 by brackets and pins 312 and 314, respectively. Rods 316 and 318 which are respectively connected to pivot pins 320 and 322 actuate cylinders 308 and 310 to move the respective rolls 304 and 306 toward and away from the mandrel and the workpiece as required in the forming operation.

In operation when rolls 304 and 306 are pressed against mandrel 70 to assist in the forming operation pressure cylinders 94 are forced upward and pressure roll 300 is raised to clear plate W as it passes. After the plate is between top roll 300 and mandrel 70 rolls 304 and 306 are raised and pressure cylinders 94 force roll 300 down and onto the plate and mandrel.

The foregoing description of the operation of the top pressure roll 300 and auxiliary pressure rolls 304 and 306 are illustrated in FIGS. 27A and 27B. In FIG. 27A the rolls 304 and 306 are shown pressed against the plate W and the mandrel as the plate passes over the centerline of the mandrel and top pressure roll 300 is raised and FIG. 27B shows the main single top pressure roll 300 in position, pressed against the plate and the mandrel after the plate has passed under roll 306 and roll 300 is repositioned while the bending operation is completed.

An advantageous alternative embodiment of the invention is partially disclosed in FIG. 27 and is disclosed in more detail in FIG. 28A and FIG. 28B. Essentially it resides in positioning the springback roll on the lower girder 14 instead of the upper girders and applying it at about the 3 o'clock position on the mandrel and plate W.

FIG. 28A and FIG. 28B each show the assembly and support means for springback roll 350 which is mounted for rotation on spindle 351 which is supported on bracket 352. Bracket 352 may be adjusted within seating guides 353. Bracket 352 is supported on base plate 354. Base plate 354 is pivotally attached to support bracket 356 and spindle 357. Cylinder 360 is pivotally fastened at its base to bracket 362 and is integrally attached to gusset 364 extending from girder 14. Rod 366 which extends from cylinder 360 is pivotally connected at 368 to base plate 354 at a point spaced sufficiently far from pivotal brackets 356 and spindle 357 so that it can function to swing plate 354 and springback roller 350 toward and away from plate W and mandrel 70 as required.

In operation cylinder 360 is actuated to move springback roll 350 from its retracted position as shown in outline in FIG. 28A and swing it upward against plate W to present it from springing away from the mandrel and thus to maintain the plate against the mandrel when the plate reaches the top pressure rolls. FIG. 28B shows essentially the same view as FIG. 28A except that springback roll 350 has been moved toward the center of baseplate 354 within guide supports 353 so that for the smaller diameter mandrel and pipe to be formed from plate W contact may still be made at the 3 o'clock position.

It is to be noted that the foregoing arrangement for the springback roll wherein it is supported on the bottom girder can be used whether the top pressure rolls comprise a single principal roll as shown in the embodiment of FIG. 27 or a pair of top pressure rolls such as shown in the embodiments of FIG. 8.

The hydraulic cylinders employed in the machine herein described are of conventional design and are readily adapted to the apparatus of the invention and its various modes of operation herein disclosed.

Modifications from the exemplary embodiments shown herein are possible without departing in any way from the underlying principles and teachings of the invention.

While there are shown and described present preferred embodiments of the invention, it is to be distinctly understood that the invention is not limited thereto, but may be otherwise variously embodied and practiced within the scope of the following claims.

I claim:

1. The method of rolling a section of metal plate into a cylindrical pipe section comprising the steps of:

pre-crimping the leading and trailing edges of said plate section to the final desired radius of said cylinder pipe section, feeding the leading edge of said plate section into a forming mill that includes an overhead mandrel having a radius smaller than said final desired radius of said pipe section and a pair of circumferentially spaced, pivotally mounted, rotatably driven, bending roll assemblies, clamping a pre-crimped edge of the plate between the mandrel and one of the bending roll assemblies, bending the plate section between the mandrel and the pair of driven bending roll assemblies by applying sufficient pressure to the mandrel to cause the mandrel, the bending rolls, and a lower beam upon which they are supported to deflect downward along the length thereof until the lower support beam deflects sufficiently to resist downward forces acting on the bending roll supports so as to maintain a constant space between the mandrel and the bending roll assemblies while the forces exerted by the bending roll assemblies shift between those bending roll assemblies to assure that said plate section is uniformly bent along the length thereof to said desired final radius, driving the bending roll assembly clamping the plate to the mandrel to advance the plate section into the forming mill, and wrapping the plate to the curvature of the mandrel through pivotal action of the other of the two bending roll assemblies.

2. The method of claim 1 wherein the forces exerted by said mandrel are applied to said mandrel along the length thereof at points diametrically opposite to said bending roll assemblies.

3. The method of claim 1 further including the step of supporting said mandrel at its ends in a manner to permit vertical movement and to restrain horizontal movement and mounting said pair of bending roll assemblies pivotally to cooperate with said mandrel during the forming of said plate section whereby one of said bending roll assemblies exerts a lever arm effect on said plate section while the other of said bending roll assemblies bends said plate section as said section passes between said roll assemblies and said mandrel.

* * * * *